US005741535A

United States Patent [19]

Cope et al.

[11] Patent Number: 5,741,535

[45] Date of Patent: Apr. 21, 1998

[54] FRAGILE FOOD PRODUCT PACKAGE

[75] Inventors: Jonathan C. Cope; Donald G. Warnock, both of Madera, Calif.

[73] Assignee: Warnock Food Products, Inc., Madera, Calif.

[21] Appl. No.: 561,843

[22] Filed: Nov. 22, 1995

[51] Int. Cl.[6] ..... B65D 81/02; B65D 85/30

[52] U.S. Cl. ..... 426/124; 426/127; 426/396; 426/411; 206/497; 206/499; 206/521.2; 206/521.6; 206/583; 206/585

[58] Field of Search ..... 426/106, 108, 426/110, 124, 127, 396, 411; 206/583, 497, 499, 521.1, 521.2, 521.6, 585

[56] References Cited

U.S. PATENT DOCUMENTS

| | | | |
|---|---|---|---|
| 2,146,719 | 2/1939 | Chaplin et al. . | |
| 2,722,365 | 11/1955 | Phipps | 206/434 |
| 3,273,302 | 9/1966 | Walter . | |
| 3,331,105 | 7/1967 | Gordon . | |
| 3,627,115 | 12/1971 | Samalson | 206/497 |
| 3,710,931 | 1/1973 | Hollinger . | |
| 3,761,289 | 9/1973 | Wolf . | |
| 4,018,905 | 4/1977 | Adamek et al. . | |
| 4,299,850 | 11/1981 | Wallen . | |
| 4,381,837 | 5/1983 | Cortopassi . | |
| 4,697,707 | 10/1987 | Engdahl . | |
| 4,865,200 | 9/1989 | Sullivan et al. | 206/583 |
| 4,873,099 | 10/1989 | Ruiz . | |
| 5,002,783 | 3/1991 | Ruiz . | |
| 5,065,665 | 11/1991 | Boecker et al. | 206/583 |
| 5,128,157 | 7/1992 | Ruiz . | |
| 5,326,577 | 7/1994 | Warnock . | |
| 5,370,229 | 12/1994 | Kroeckel et al. | 206/523 |
| 5,579,917 | 12/1996 | Lofgren et al. | 206/583 |

*Primary Examiner*—David L. Lacey
*Assistant Examiner*—Curtis E. Sherrer
*Attorney, Agent, or Firm*—Pretty, Schroeder & Poplawski

[57] ABSTRACT

A package includes a protective band having a cavity for receiving a fragile food product unit. A wrap material is tightly secured around the food product unit and the protective band to form a package. The protective band may have alternating narrow segments and wide segments to ensure that the wrap material keeps the top and bottom extremities of the food product unit inside the protective band and spaced from the upper and lower edges of the wide segments of the protective band.

20 Claims, 3 Drawing Sheets

FIG. 1
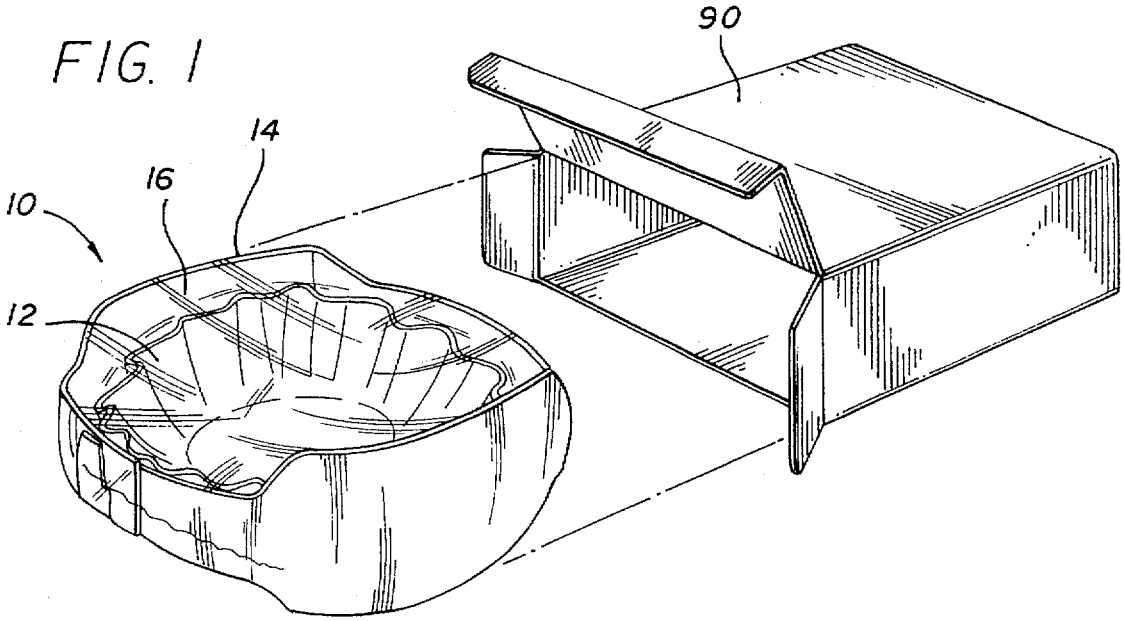
FIG. 2A
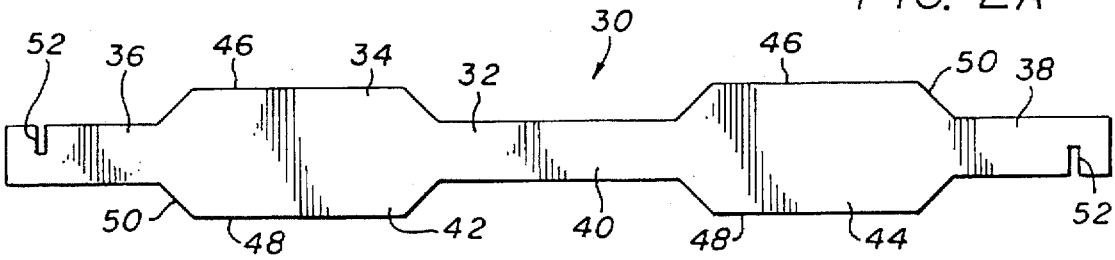
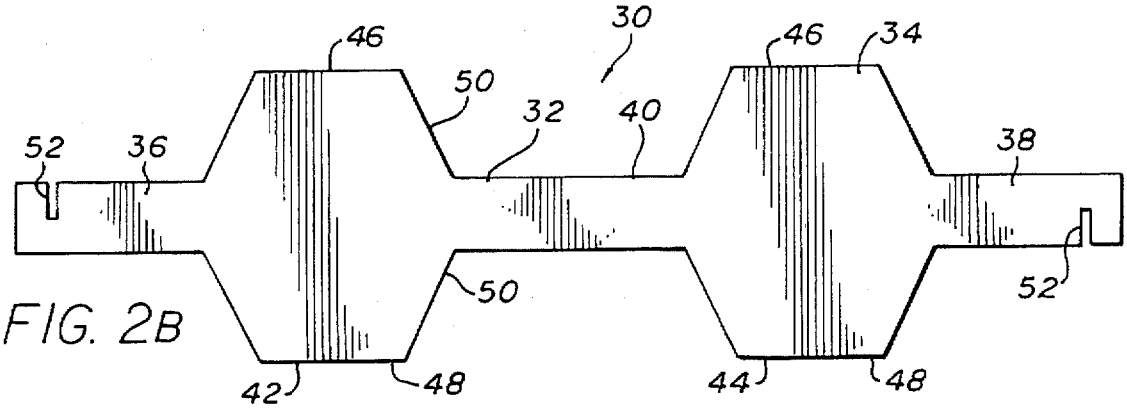
FIG. 2B
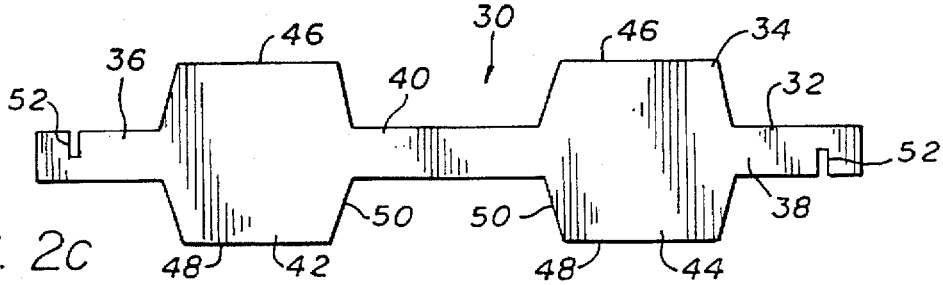
FIG. 2C

FRAGILE FOOD PRODUCT PACKAGE

This invention relates to fragile food product packages, and, in particular, to a fragile food product that is secured in a protective band to protect the food product from damage during shipment, storage and display.

BACKGROUND OF THE INVENTION

A long-standing problem in the food packaging industry is the packaging of brittle or fragile food products, such as tortilla products, in a manner sufficient to allow the product to be shipped and stored without damage. For example, one popular food product is a tostada bowl or shell that is made from a grain, such as flour or corn materials, and that is generally formed with a plurality of convolutions in a circular sidewall, which is held together by a common base or bottom. The unreinforced sidewall, and especially an upper edge thereof, are particularly susceptible to breakage. Irregularities in the sidewall or base of the shell and uneven attachment of the sidewall to the base result in additional structural weaknesses of the bowl.

Because of their fragile and non-reinforced construction, it is difficult to stack or nest a plurality of such shells or bowls for shipment. Breakage frequently occurs due to uneven distribution of impact or shock loads. In particular, impact loads during shipping and handling may be introduced into the stack from the lowermost bowl in the stack through any cardboard or paper packaging material. These loads are then transferred through the entire stack resulting in bowl breakage and damage.

Two types of packages for a tostada bowl are described in U.S. Pat. Nos. 4,873,099, 5,002,783 and 5,128,157 to Ruiz. The first package is a "U-shaped" structure or form wherein the base and sides of the form define a cavity for receiving a stack of nested bowls. The base of the lowermost bowl of the stack engages the base of the U-shaped form. The U-shaped form and nested stack are then wrapped in a heat-shrinkable film to hold the stack in contact with the form. The U-shaped form tends to prevent the transfer of impact loads to the nested stack when it is in the inverted position, i.e., when the sides of the form are directed downward to contact another package or surface. The form, however, does not prevent the transfer of impact loads to the nested stack in the upright position. Such loads are transferred to the lowermost bowl in the stack through the base of the U-shaped form, which can result in breakage or damage to the bowls. In addition, the U-shaped form leaves a portion of the upper edges of the sides of the bowls exposed to impact forces from the side.

The second package described in the Ruiz patents includes a pair of conical members placed at the top and bottom of the nested stack of tostada bowls. The top cone is introduced into the interior of the uppermost bowl of the stack while the bottom cone is place around the upright side of the lowermost bowl of the stack. A heat-shrinkable film is then placed around the cones and stack. A disadvantage of this package is that the nested stack carries the load of the film. Impact loads are also transferred to the nested stack through the conical members. In addition, the sides of the bowls are exposed to impact forces around the full periphery of their upper edges.

Another type of package for a tostada bowl is described in U.S. Pat. No. 5,326,577 to Warnock. This package includes a L-shaped cardboard structure or form having a flat upright back portion, a base portion that extends outwardly from the bottom of the back portion, and a rim portion that extends upwardly from the base portion towards a top end of the base portion. Tostada bowls are supported in the form, with the lowermost tostada shell supported by the flat back portion. A lower outer periphery of the tostada shells of the nested stack are supported by the base and rim portions, with the rim portion extending over the edge of the topmost tostada shell. A shrink wrap fully encloses the entire cardboard form and the nested stack of tostada bowls. By holding the food product tightly within the interior space partially defined by the back portion, base portion and rim portions, the food product is substantially protected from damage caused by impact with other packages or surfaces. The form has its disadvantages, however, because impact loads on the flat backing portion of the form can still be transferred to the base of the lowermost shell of the nested stack and other parts of the shells are exposed to direct impact forces.

In view of the above, it will be appreciated that there is still a need for a package for a fragile food product that will protect the food product from damage during shipment, storage and display. The present invention satisfies this need and provides further related advantages.

SUMMARY OF THE INVENTION

The present invention is embodied in a package that protects a fragile food product from damage during shipping and handling. The package includes a unit of fragile food product and a protective band located around the unit. The fragile food product unit is oriented within the band such that its height is less than the width of the protective band. A wrap material, such as a heat-shrinkable film or band, is secured around the fragile food product unit and the protective band to hold the package together. The wrap material supports the fragile food product unit in the protective band such that the wrap material engages the bottom of the fragile food product unit when the package is in an upright position and engages the top of the fragile food product unit when the package is in an inverted position.

A feature of the present invention is that the protective band may include alternating narrow segments and wide segments around its periphery, wherein the wide segments have widths that are greater than the height of the fragile food product unit and the narrow segments have widths that are less than the widths of the wide segments. The widths of the narrow segments may further be selected such that when the wrap material is tautly secured around the protective band and food product unit, the wrap material is drawn into the protective band cavity to pull the food product unit inside the protective band. An advantage of the above feature is that the food product unit will be suspended inside the protective band and spaced from an edge of the protective band by a cushion of wrap material that acts much like a hammock. Thus, the protective band will absorb the full brunt of impact forces applied to its end without transferring those forces through to the food product unit.

Further advantages may be obtained by centrally locating the narrow segments of the protective band between the top and bottom edges of the wide segments of the protective band. With this type of arrangement, the wrap material will hold the food product unit fully inside the protective band and spaced from both ends of the protective band, protecting the food product unit from impact loads regardless of whether the package is shipped or stored in an upright position or in an inverted position. In addition, in the case of tostada bowls or shells, the narrow segments of the protective band may be located around and adjacent the fragile upper edges of the bowls to protect them from side impact loads.

Another feature of the present invention is that the wide segments of the protective band may be made long enough peripherally to support the package in a stable position, without rocking, during shipment. It will be appreciated, however, that the length of the wide segments should preferably not be so long as to eliminate the hammocking feature provided by having longer narrow segments. In the preferred embodiment, both features are accommodated, namely, suspension of both ends of the fragile food product unit within a stable protective band.

A further feature of the present invention is a fastener, preferably located on at least one of the narrow segments of the protective band, for holding the band together around the food product unit before wrapping. The fastener may also be placed on the wide segments of the band or at a transition between the wide and narrow segments.

Another feature of the present invention is that the fragile food product unit itself may be wrapped. For example, a nested stack of tostada bowls may be wrapped in a heat-shrinkable film before being placed in the protective band.

Other features and advantages of the present invention will become apparent from the following description of the preferred embodiments, taken in conjunction with the following drawings, which illustrate, by way of example, the principals of the invention.

BRIEF DESCRIPTION OF THE DRAWINGS

FIG. 1 is a perspective exploded view of a fragile food product package according to the present invention.

FIGS. 2A–2D are alternative embodiments, respectively, of flat strips for forming protective bands according to the invention.

DETAILED DESCRIPTION OF THE PREFERRED EMBODIMENT

Figure 2D:
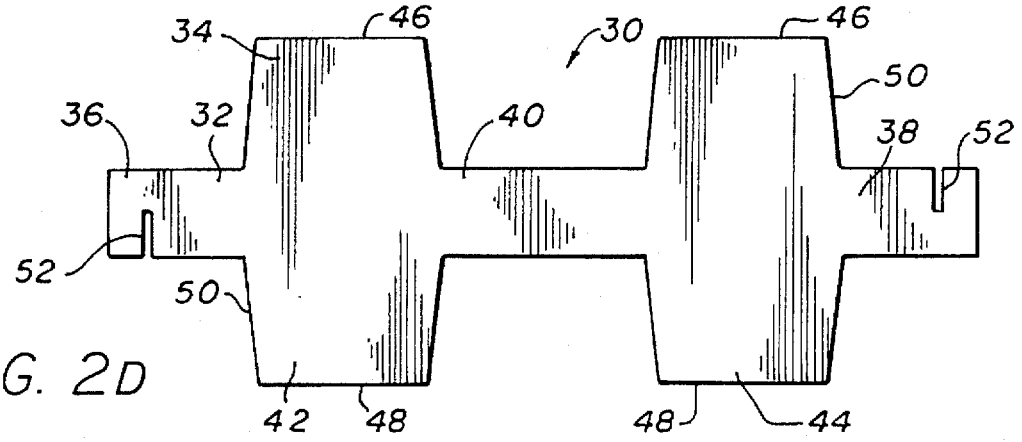

As shown in the accompanying drawings, the present invention is embodied in a fragile food product package, indicated generally by reference numeral 10 in FIG. 1. In the preferred embodiment, the package 10 includes several fragile food items arranged in a nested stack 12, a protective corrugated cardboard band 14 around the nested stack, and a film 16 surrounding the nested stack and the band.

Figure 3A:
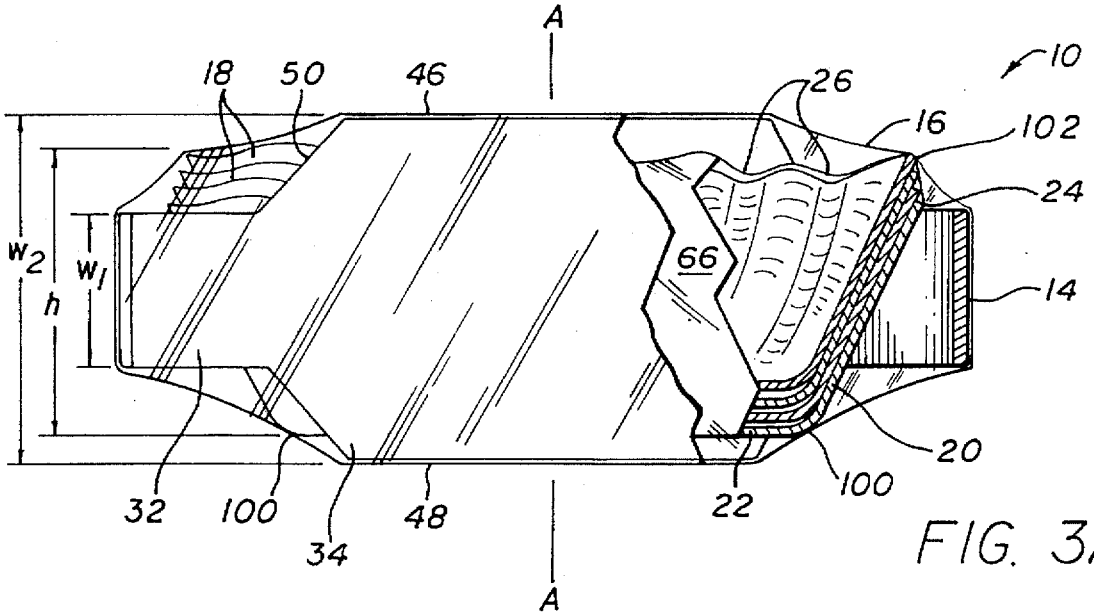
FIG. 3A is a side view, partially cutaway, of a fragile food product package, including a protective band formed from the flat strip shown in FIG. 2A.

With reference to FIG. 3A, the fragile food product items are tostada bowls or shells 18. Each shell includes a continuous thin and brittle sidewall 20 arranged in a circular fashion about a supporting thin and brittle flat base 22, wherein the continuous sidewall outwardly tapers or diverges from the base to terminate in a continuous upper edge 24. The sidewall may be provided with a plurality of convolutions 26 that radiate upwardly and outwardly from the base, such as are commonly found in tostada shells of this type.

The individual tostada bowls may be placed in a stack by inserting the base of one bowl into the opening formed by the upper edge of an adjacent bowl and so on to form the nested stack. The height h of the nested stack is measured along an axis A through the center of the shells from an outside surface of the base of the lowermost bowl to a line perpendicular to axis A that passes through the upper edge of the sidewall of the uppermost bowl at its highest point.

It will be appreciated that although a nested stack of tostada shells are shown in the preferred embodiment, the invention described herein may be employed with a single tostada shell or may be employed with other fragile food products such as tostada cups, flat tostadas, rectados (flat fried rectangular tortillas), taco shells, enchilada tubes, ice cream cones, nacho chips, and the like, and various configurations thereof. In each case, the height h of the fragile food unit is measured along any desired direction from a line perpendicular to the desired direction passing through the lowest point of the food unit to a line perpendicular to the desired direction passing through the highest point of the food unit.

The corrugated cardboard band 14 of the present invention may be formed from a flat corrugated cardboard strip 30, such as those shown in FIGS. 2A–2D, respectively. The cardboard strip 30 may include a plurality of alternating narrow segments 32 and wide segments 34. FIGS. 2A and 2B show strips for a nested stack of tostada bowls. The strip shown in FIG. 2A is for a small number of bowls (e.g. four) whereas the strip in FIG. 2B has wider segments to accommodate a larger number of bowls (e.g. eighteen). FIGS. 2C and 2D show strips for a nested stack of bowls having a relatively smaller diameter, hence the strips are shorter in length. FIG. 2C shows strips for a small number of such bowls (e.g. six) and FIG. 2D shows a strip for a stack of a larger number of bowls (e.g. twenty-four).

An important feature of the present invention, which will be described in greater detail below is that the widths of the narrow and wide segments are selected such that the food product unit will be suspended between the upper and lower edges of the band, thus protecting the food product unit from damage due to impact forces applied to the upper and lower edges of the band. In the preferred embodiment, each strip 30 includes first and second narrow end segments 36, 38, a narrow intermediate segment 40 and first and second wide segments 42, 44. The narrow intermediate segment is located between the wide segments and the narrow end segments are located at each end of the strip, respectively. Each wide segment has an upper edge 46 and a lower edge 48. The narrow end segments and the narrow intermediate segment may be centrally located between the upper and lower edges of the wide segments. Tapered regions 50 may be provided between the narrow segments and the wide segments to transition one segment into the other. The purpose of the taper will be described in greater detail below in connection with the assembly of the final package.

The cardboard strip may be scored every 1 and ½ inch or so to facilitate forming the strip into a ring or other desired shape. One or both ends of the strip are also provided with a fastener to hold the ends of the strip together. Many fasteners are known to those having ordinary skill in the art and include adhesives and/or interlocking portions of the strip. In the preferred embodiment, the fastener includes a transverse slot 52 in both narrow end segments 36, 38 that may be interlocked to form the ring. The slot, however, may also be located at the wide segments 42,44 or at the tapered regions 50. The width of the slot 52 may also be varied. On the one hand, the slot width may be equal to or less than the thickness of the strip material such that the ends of the strip tightly interlock. On the other hand, the slot width may be much larger than the sheet thickness. For example, the slot width may be ½ inch. With this slot width, the cardboard strip will provide a loose fit around the food items until the food items and strip are wrapped in the plastic film 16, at which time the ends of the strip slide relative to each other to provide a snug fit around the food items.

It is noted that in the preferred embodiment, the protective band 14 is generally circular or round. The band, however, has the ability to conform to the shape of a stack that is out of round or that is otherwise irregular (such as a square, rectangle or triangle shape). In contrast, some prior art packaging is more fixed and rigid and does not have the ability to conform to irregular shapes. This rigidity causes increased instances of product breakage.

It will be appreciated that the cardboard strip 30 may be made from other materials, such as corrugated board, chip board, stiff paper, plastic or heavy foil. Such materials are typically suitable for forming, yet stiff or rigid enough to resist buckling, folding, crumbling or collapsing due to the tension of the film 16, the compression of the stacked product or the jarring and bouncing of shipping. Such materials also typically provide adequate rigidity to protect the fragile food product contained within the ring from side impact loads. Graphics may also be applied to the strip, as desired.

Figure 3B:
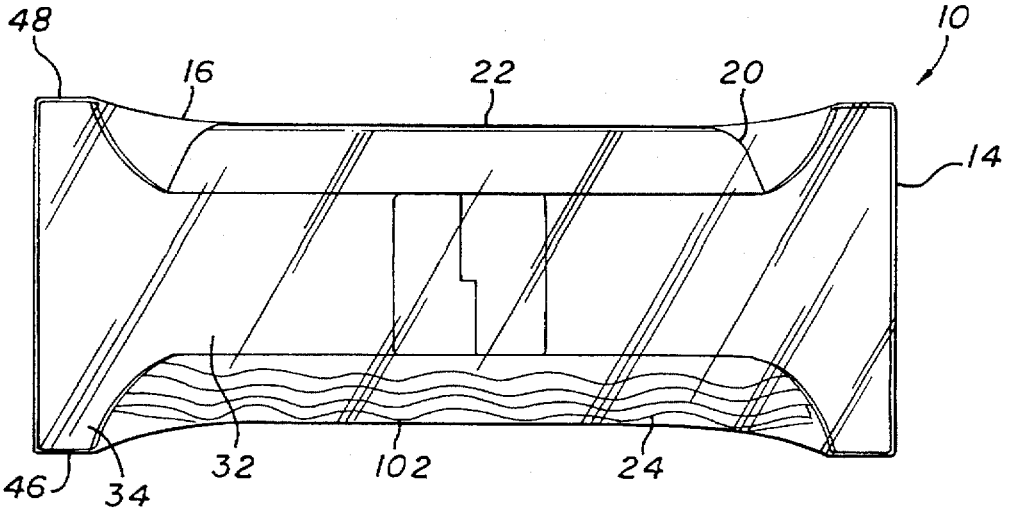
FIG. 3B is a side view of the fragile food product package shown in FIG. 3A, wherein the package is inverted and rotated 90 degrees from that shown in FIG. 3A.
Figure 4:
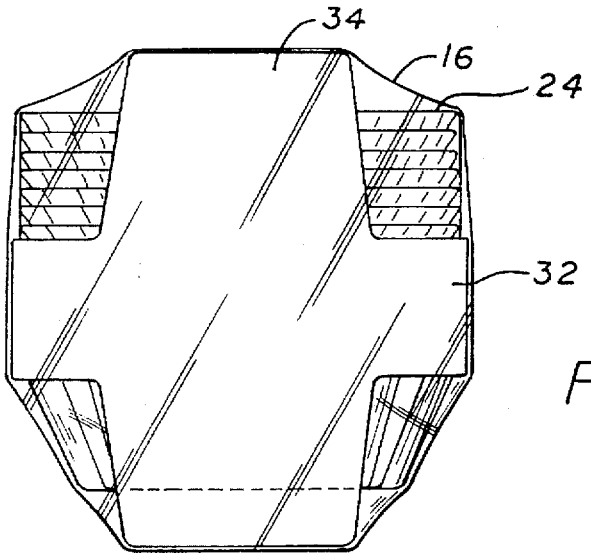
FIG. 4 is a side view of a fragile food product package, including a protective band formed from the flat strip shown in FIG. 2B.

With reference to FIGS. 3A and 3B, the assembly of the fragile food product package of the present invention will now be described. First, in the case of a package of tostada bowls, the individual tostada bowls are prepared according to well known methods. As described earlier, each bowl typically includes a flat base 22 and a continuous sidewall 20 terminating in a continuous upper edge 24. A predetermined number of bowls are then placed in a nested stack. For example, each nested stack may contain four bowls (FIG. 3A) or any other desired number (FIG. 4). As described earlier, the height h of the stack is measured along an axis A through the center of the stack of bowls from the base of the lowermost bowl to a line perpendicular to axis A that passes through the upper edge of the sidewall of the uppermost bowl at its highest point.

To ensure that the nested stack of bowls are held together, a clear plastic film 66, such as a stretch wrap or heat-shrinkable film, may be tightly wrapped around the nested stack. Such wrapping is not necessary, however, and the nested stack may be packaged without such wrap.

Next, the nested stack is placed inside the protective band 14. This may be done by either forming the band into a ring, then pushing the nested stack into the cavity of the ring or wrapping the unfastened band around the nested stack and fastening the ends of the band together. In either case, after this step is completed, the nested stack is inside the protective band and the combined stack/protective band unit is wrapped in the clear plastic film 16. The film may be any suitable stretch wrap or heat-shrinkable material which will hold the object being wrapped in an integral and unitary construction.

Next, the wrapped stack/protective band package 10 may be placed in a display carton 90 for shipping (see FIG. 1). Preferably, when the display carton is used, the package 10 is inverted (see FIG. 3B) before placement in the display carton and will be shipped in the inverted position. The display carton 90 is sized to provide a snug fit for the package 10 without applying undue compressive forces on the package upon closing the carton. The display carton helps protect all exposed surfaces of the nested stack from damage. Several display cartons may be packed together and stacked, if desired, in a conventional shipping carton (not shown). Of course, the display carton may be omitted and several individual packages may be placed directly in the cardboard shipping carton. It is again preferable, however, that the individual packages 10 be inverted before placement in the shipping carton. Stiff paper or corrugated sheets may be used to separate layers of packages.

Conventional equipment may be employed for wrapping the clear plastic film around the package. Such equipment is well known in the art and typically includes a sealer for sealing the clear plastic film after it has been wrapped around the stack/protective band unit and a heat shrink tunnel or other machine for otherwise tautly securing the film to the stack/protective band unit. The sealing machine may be an L-sealer. In the preferred embodiment, the film is heat shrinkable and is shrunk in a heat shrink tunnel. During shrinkage, the film is stretched over the upper and lower edges 46, 48 of the wide segments (see FIGS. 3A and 3B), and is sucked into the open cavity of the protective band to engage and support the nested stack of bowls.

Conventional manufacturing equipment can perform the simple and inexpensive manufacturing steps required to fabricate the cardboard strips. Unlike conventional tortilla packages of the prior art, no complicated cardboard blank is required having numerous fold lines and difficult-to-form cutout portions. Manufacture is therefore quick and inexpensive. Assembly into the final folded package is easily performed manually. In contrast to prior art packages, which may require numerous assembly steps of folding precut blanks and inserting tabs into precut slots, the package of the invention is quickly and efficiently assembled such that a large number of such packages can be quickly formed using relatively few workers. Further, as assembly is quite simple, no substantial amount of teaching is required to instruct workers, as can be required with the more complicated packaging structures of the prior art.

As mentioned earlier, a feature of the present invention is that the protective band 14 includes alternating narrow segments 32 and wide segments 34. Each wide segment includes upper and lower edges 46, 48, respectively. The narrow segments have a width $w_1$, measured in the direction of axis A, that is preferably less than the height h of the nested stack of tostada shells, while the wide segments have a width $w_2$, measured in the direction of axis A, that is preferably greater than the height h of the nested stack of tostada shells. Due to the difference in width of the segments, the clear plastic film 16, when wrapped tightly around, or when shrunk around, the nested stack/protective band combination, will extend into the storage cavity of the band and push the nested stack toward the interior of the storage cavity and away from the upper and lower edges 46, 48 of the wide segments. The film thus acts as a hammock that suspends the nested stack on a cushion of film and supports the nested stack at a location spaced from the edges of the protective band.

In particular, when the package is shipped or stored in an upright position as shown in FIG. 3A, the base 22 of the bottommost tostada shell will be supported at locations 100 by the film and will not engage another package or surface below it. Similarly, when the package is inverted as shown in FIG. 3B, the continuous upper edge 24 of the topmost shell will be supported at locations 102 by the film (see also FIG. 3A) and will not engage another package or surface below it.

With reference to FIG. 3A, it is noted that the narrow segments 32 are centrally located relative to the upper and lower edges 46, 48 of the wide segments 34 of the protective band. The widths of the narrow segments are also small enough to ensure that the clear plastic film 16 will suck in when wrapped such that the nested stack will be spaced from the upper and lower edges of the wide segments. It will be appreciated, however, that the narrow segments may extend directly from the upper edge or lower edge of the wide segments if it is desired to keep only one of the ends of the nested stack away from the edge of the protective band.

If desired, the narrow segments 32 may be made wider to protect the fragile continuous upper edges 24 of the individual tostada bowls in the nested stack. In the preferred embodiment, however, it is considered more desirable to have thinner narrow segments for achieving the maximum effect than it is to have a wider narrow segments that cover the upper edges of all the tostada bowls in the nested stack. See, for example, the location of the narrow segments relative to the upper edges of the tostada bowls in FIG. 4.

The relative lengths of the narrow and wide segments around the periphery of the nested stack is also important. On the one hand, if the total length of the wide segments 34 is kept shorter, the film will move further into the storage cavity of the ring, thus increasing the hammock effect. On the other hand, it is preferred that the wide segments have a total length that is sufficient to support the package on a flat surface in a stable manner, without rocking or other undesirable movement.

As mentioned above, the protective band may include tapered regions 50 between the wide segments 34 and the narrow segments 32. The tapered regions add strength to the wide segments to help prevent them from buckling. In addition, the tapered regions help eliminate tearing or bursting of the film as it is pulled around the edges of the protective band. Depending on the size and number of tostada bowls in a package, the angle of taper may be adjusted to insure that the wide segments of the ring have a sufficient length to support the package in a stable manner.

Figure 5:
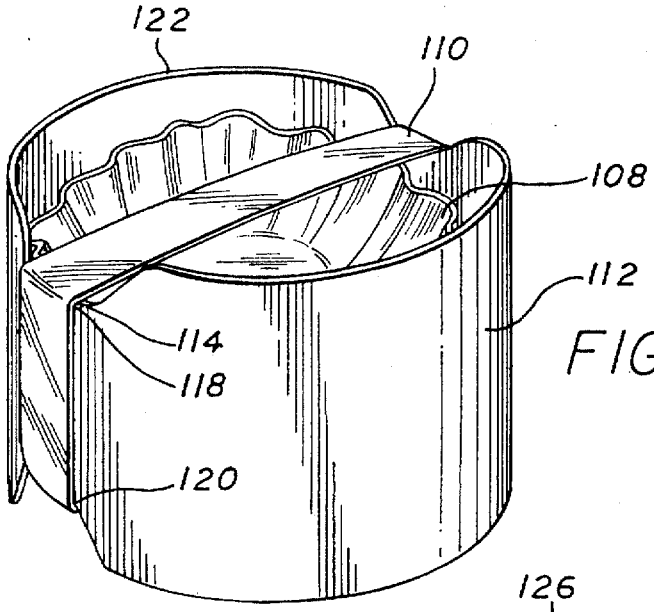
FIG. 5 is a perspective view of a first alternative embodiment of a fragile food product package according to the present invention having one heat-shrinkable band.
Figure 6:
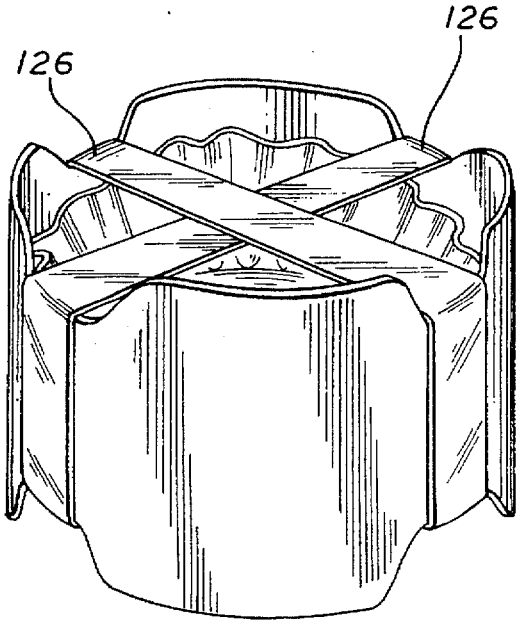
FIG. 6 is a perspective view of a second alternative embodiment of a fragile food product package according to the present invention having two heat-shrinkable bands.

With reference to FIG. 5, a heat-shrinkable band 110 is substituted for the clear plastic film 16 shown in FIG. 3A. In this embodiment, a protective ring 112 surrounding a nested stack 108 includes two narrow segments 114 and two wide segments 116. The narrow segments are diametrically opposed and form upper and lower seats 118, 120, respectively, for receiving the heat-shrinkable band 110. The size of the band before shrinking is sufficient to permit it to be pulled over one of the wide segments and into position adjacent the narrow segments. During shrinkage, the band 110 will be stretched between the narrow segments into the cavity of the protective band and will push the nested stack 108 further into the cavity and away from upper and lower edges 122, 124 of the wide segments. FIG. 6 shows a similar embodiment employing two heat-shrinkable bands 126 in a criss-cross pattern. Of course, other securement devices may be used instead of the heat-shrinkable bands, such as elastic (or rubber) bands, string, strapping, tape and the like. Preferably, the securement device is sufficiently wide to prevent the food items from falling out of the protective ring. An advantage of using the securement band 110 or bands 126 instead of plastic film is that the package may be easily unwrapped by simply cutting the bands. In addition, using heat-shrinkable bands save the expense and floor space associated with a sealing machine (or an additional sealing machine if one is already being used to pre-wrap the nested stack of bowls prior to assembly within the protective band as discussed in connection with FIG. 3A above).

From the foregoing, it will be appreciated that the fragile food product package of the present invention provides a protective band having wide segments extending above and below the extremities of the food product to protect it and a clear plastic film or securement band tightly wrapped around the protective band and food product to create a unitary package. The narrow segments of the protective band allow the wrap material to reach in and support and protect the food product and expose the contents for viewing by a consumer. The consumer can thus quickly verify that the product has not been damaged or spoiled and can verify the quantity of the product.

While a particular form of the invention has been illustrated and described, it will be apparent that various modifications can be made without departing from the spirit and scope of the invention. Thus, while a circular protective band has been shown and described in the present application, any shape of protective band, such as a square or triangle, may also be used. In addition, it will be appreciated that the protective band's narrow and wide segments may be of various shapes and number and still achieve the benefits of the invention. Accordingly, it is not intended that the invention be limited, except as by the appended claims.

We claim:

1. A package containing a fragile food product, comprising:

a fragile food product unit, wherein the unit has a height measured along a first direction from a bottom of the unit to a top of the unit;

a protective band located around the unit and defining an opening receiving the fragile food product unit between a first open end and a second open end of the protective band such that the band opening is aligned in the first direction from the first open end to the second open end, wherein the band has a width, measured in the first direction, that is greater than the height of the fragile food product unit; and a first wrap material tautly secured around the fragile food product unit and the first and second open ends of the protective band to form a package, wherein the first wrap material supports the fragile food product unit in the opening of the protective band such that the first wrap material engages the bottom of the fragile food product unit when the package is in an upright position and engages the top of the fragile food product unit when the package is in an inverted position.

2. The package of claim 1, wherein the protective band has alternating narrow segments and wide segments around the periphery of the band, the wide segments having upper and lower edges and having widths measured in the first direction that are greater than the height of the fragile food product unit, the narrow segments having widths measured in the first direction that are less than the widths of the wide segments, and wherein said widths of the narrow segments are selected such that the first wrap material keeps the top of the fragile food product unit inside the band and spaced from the upper edges of the wide segments of the band.

3. The package of claim 2, wherein the narrow segments are spaced from the upper edges and the lower edges of the wide segments such that the first wrap material keeps the bottom of the fragile food product unit inside the band and spaced from the lower edges of the wide segments of the band.

4. The package of claim 2, wherein the first wrap material includes a heat-shrinkable film that surrounds and is tautly secured to the protective band.

5. The package of claim 2, wherein the first wrap material includes a securement band around the fragile food product unit and the protective band, the securement band seated against two diametrically opposed narrow segments of the protective band.

6. The package of claim 2, wherein the fragile food product unit is wrapped in a second wrap material and the fragile food product unit and the second wrap material are located inside the opening of the protective band.

7. The package of claim 2, wherein the protective band includes a strip of cardboard material fastened together at its ends.

8. The package of claim 3, further comprising tapered regions between the narrow segments and the wide segments of the protective band to transition one segment into another.

9. The package of claim 3, wherein the wide segments have a combined length that is sufficient to support the package on a flat surface in a stable manner in the upright position and in the inverted position.

10. A package containing a fragile food product, comprising:

a plurality of fragile food product items arranged in a nested stack, each item of the stack having a closed end and an open end, wherein the closed end of one item of the stack is received in the open end of an adjacent item of the stack and the items are stacked in a first direction, and wherein the nested stack has a height measured along the first direction from a bottom of the closed end of a lowermost item of the stack to a top of an open end of the uppermost item of the stack;

a protective band located around the nested stack and defining an opening receiving the nested stack therein such that the band opening is aligned in the first direction, the protective band having alternating narrow segments and wide segments around the periphery of the band, wherein the wide segments have upper and lower edges and have widths measured in the first direction that are greater than the height of the nested stack and the narrow segments have widths measured in the first direction that are less than the widths of the wide segments; and a first wrap material tautly secured completely around the nested stack and the protective band to form a package, wherein the first wrap material supports the nested stack in the protective band such that the first wrap material engages the lowermost item of the nested stack when the package is in an upright position and engages the uppermost item of the nested stack when the package is in an inverted position;

wherein said widths of the narrow segments are selected such that the tautly secured wrap material keeps the top of the open end of the uppermost item of the nested stack inside the protective band and spaced from the upper edges of the wide segments of the protective band.

11. The package of claim 10, wherein the narrow segments are spaced from the upper edges and the lower edges of the wide segments such that the first wrap material keeps the bottom of the closed end of the lowermost item of the nested stack inside the protective band and spaced from the lower edges of the wide segments of the protective band.

12. The package of claim 11, wherein the first wrap material includes a heat-shrinkable film that surrounds and is tautly secured to the protective band.

13. The package of claim 11, wherein the first wrap material includes a securement band around the nested stack and the protective band, the securement band seated against two diametrically opposed narrow segments of the protective band.

14. The package of claim 11, wherein the nested stack is wrapped in a second wrap material and wherein the nested stack and the second wrap material are located inside the opening of the protective band.

15. The package of claim 11, wherein the protective band includes a strip of cardboard material fastened together at its ends.

16. The package of claim 11, further comprising a carton corresponding in size to the wrapped stack such that the wrapped is held inside the carton to prevent relative movement between the wrapped stack and the carton during shipping.

17. The package of claim 11, wherein each item of the nested stack has a sidewall terminating in a continuous upper edge that defines said open end and wherein the narrow segments of the protective band are located around and adjacent the continuous upper edges of at least one of the items of the nested stack.

18. The package of claim 11, further comprising tapered regions between the narrow segments and the wide segments of the protective band to transition one segment into another.

19. The package of claim 11, wherein the wide segments have a combined length that is sufficient to support the package on a flat surface in a stable manner in the upright position and in the inverted position.

20. A package containing a fragile food product, comprising:

a plurality of fragile food product items arranged in a nested stack, each item of the stack having a closed end and an open end, wherein the closed end of one item of the stack is received in the open end of an adjacent item of the stack and the items are stacked in a first direction, and wherein the nested stack has a height measured along the first direction from a bottom of the closed end of a lowermost item of the stack to a top of an open end of the uppermost item of the stack;

a protective band located around the nested stack and defining an opening receiving the nested stack therein such that the band opening is aligned in the first direction, the protective band having alternating narrow segments and wide segments around the periphery of the band, wherein the wide segments have upper and lower edges and have widths measured in the first direction that are greater than the height of the nested stack and the narrow segments have widths measured in the first direction that are less than the widths of the wide segments; and a first wrap material tautly secured around the nested stack and the protective band to form a package, wherein the first wrap material supports the nested stack in the protective band such that the first wrap material engages the lowermost item of the nested stack when the package is in an upright position and engages the uppermost item of the nested stack when the package is in an inverted position;

wherein said widths of the narrow segments are selected such that the tautly secured wrap material keeps the top of the open end of the uppermost item of the nested stack inside the protective band and spaced from the upper edges of the wide segments of the protective band;

wherein the narrow segments are spaced from the upper edges and the lower edges of the wide segments such that the first wrap material keeps the bottom of the closed end of the lowermost item of the nested stack inside the protective band and spaced from the lower edges of the wide segments of the protective band; and wherein the first wrap material includes a heat-shrinkable film that surrounds and is tautly secured to the protective band.

* * * * *